US006699091B1

(12) United States Patent
Warner

(10) Patent No.: US 6,699,091 B1
(45) Date of Patent: Mar. 2, 2004

(54) HAND-LAUNCHABLE UNDERWATER PROJECTILE TOY

(76) Inventor: Jon A. Warner, 606 Cowles Rd., Santa Barbara, CA (US) 93108

( * ) Notice: Subject to any disclaimer, the term of this patent is extended or adjusted under 35 U.S.C. 154(b) by 0 days.

(21) Appl. No.: 09/434,839

(22) Filed: Nov. 4, 1999

(51) Int. Cl.[7] ..... A63H 23/00
(52) U.S. Cl. ..... 446/153; 446/161; 446/163
(58) Field of Search ..... 446/153, 161, 446/163

(56) References Cited

U.S. PATENT DOCUMENTS

| | | | |
|---|---|---|---|
| 16,819 | A | 3/1857 | Scholfield et al. |
| 1,297,273 | A | 3/1919 | Straub et al. |
| 1,410,872 | A | 3/1922 | Baldwin |
| 1,544,003 | A | 6/1925 | Henderson |
| 1,994,490 | A | 3/1935 | Skinner |
| 2,364,197 | A | 12/1944 | Dee |
| 2,459,357 | A | 1/1949 | Bell |
| 2,480,927 | A | 9/1949 | Hopkins |
| 2,494,026 | A | 1/1950 | Anderson |
| 2,671,398 | A | 3/1954 | Peck |
| 2,848,945 | A | 8/1958 | Brumbaugh |
| 2,892,409 | A | 6/1959 | Lyon |
| 2,925,276 | A | 2/1960 | Leclerc |
| 2,943,568 | A | 7/1960 | Pavian |
| 2,984,181 | A | 5/1961 | Baldwin, Jr. |
| 3,007,410 | A | 11/1961 | Blacker |
| 3,015,269 | A | 1/1962 | Potts, Jr. |
| 3,060,854 | A | 10/1962 | Maretti |
| 3,141,434 | A | 7/1964 | Van Billiard |
| 3,150,625 | A | 9/1964 | Brooks |
| 3,183,002 | A | 5/1965 | Updaw |
| 3,196,823 | A | 7/1965 | Thurston |
| 3,216,727 | A | 11/1965 | Hunter |
| 3,225,488 | A | 12/1965 | Goldfarb |
| 3,251,154 | A * | 5/1966 | Taylor |
| 3,434,425 | A | 3/1969 | Critcher |
| 3,516,358 | A | 6/1970 | Manninen et al. |
| 3,532,300 | A | 10/1970 | Bucklisch et al. |
| 3,544,113 | A | 12/1970 | Hand |
| 3,575,123 | A | 4/1971 | Shepherd et al. |
| 3,727,570 | A | 4/1973 | Molinski |
| 3,746,334 | A | 7/1973 | Stubblefield |
| 3,754,349 | A | 8/1973 | Wallace |
| 3,853,320 | A | 12/1974 | Carella |
| 3,915,092 | A | 10/1975 | Monson et al. |

(List continued on next page.)

FOREIGN PATENT DOCUMENTS

| | | |
|---|---|---|
| GB | 5159 | of 1898 |
| SU | 1087143 A | 4/1984 |

OTHER PUBLICATIONS

Photographs of Toypedo toy and packaging, 1997.
Photographs of Poolaris toy and packaging, 1998.
Water Warehouse catalog, p. 22, Spring 1999.
English language abstract of Soviet Union Patent No. 1087–143–A, 1985.

*Primary Examiner*—Derris H. Banks
*Assistant Examiner*—Ali Abdelwahed
(74) *Attorney, Agent, or Firm*—Kolisch Hartwell, P.C.

(57) ABSTRACT

A hand-launchable underwater projectile toy having a hydrodynamic body and a novel trajectory stabilizing structure extending from the body and configured to impart a righting-moment to the body during underwater travel. The stabilizing structure includes one or more drag-producing surfaces extending in a non-radial direction about the central axis. In another embodiment, the stabilizing structure includes at least one portion that is user-adjustable to impart a selected steering-moment to the body during underwater travel. In a further embodiment, the toy includes a positively buoyant first portion and a negatively buoyant second portion, which cooperate to urge the body into a selected orientation when the toy is suspended in water.

77 Claims, 6 Drawing Sheets

U.S. PATENT DOCUMENTS 3,916,560 A * 11/1975 Becker
4,004,514 A 1/1977 Daniels
4,021,041 A 5/1977 Goldfarb et al.
4,052,812 A 10/1977 Kupperman et al.
4,109,579 A 8/1978 Carter
4,144,669 A * 3/1979 Ogawa
4,153,223 A 5/1979 Romer et al.
4,241,535 A 12/1980 Tsukuda
4,374,493 A * 2/1983 Hoffing
4,395,965 A 8/1983 Lang
4,448,106 A 5/1984 Knapp
4,463,954 A 8/1984 Panse et al.
4,478,148 A 10/1984 Applebaum et al.
4,563,161 A 1/1986 Zimmerman
4,569,300 A 2/1986 Ferris et al.
4,674,706 A 6/1987 Hall
H329 H 9/1987 Bahnck
4,748,912 A 6/1988 Garcia
4,826,465 A * 5/1989 Fleischmann ..... 446/162
4,964,593 A 10/1990 Kranz
4,978,088 A 12/1990 Himmert et al.
4,979,922 A 12/1990 Clark
5,080,017 A 1/1992 Asikainen
5,125,344 A 6/1992 Kline et al.
5,129,325 A 7/1992 Matzagg
5,224,665 A 7/1993 Goldsberry et al.
5,269,514 A 12/1993 Adler et al.
5,306,191 A 4/1994 Phillips et al.
5,400,712 A 3/1995 Herbage et al.
5,498,160 A 3/1996 Farina et al.
5,514,023 A 5/1996 Warner
5,725,179 A 3/1998 Gilman et al.
5,865,662 A 2/1999 Dammann
5,882,240 A * 3/1999 Larsen ..... 446/225

* cited by examiner

HAND-LAUNCHABLE UNDERWATER PROJECTILE TOY

FIELD OF THE INVENTION

The present invention relates generally to toys for use in water, and more particularly to hydrodynamic toys that can be hand-launched to travel along selected underwater trajectories.

BACKGROUND

Aerodynamic toys capable of being hand-launched through the air have been known for many years, and include balls, flying discs, boomerangs, toy gliders, etc. Aerodynamic toys typically are characterized by a combination of properties allowing a user to launch the toy into the air by hand so that the toy travels a substantial distance through the air along a trajectory selected by the user. Specifically, each of these toys has a size and shape that, in relation to the weight of the toy, enables an average user to apply a launching momentum sufficient to overcome, at least temporarily, the forces of gravity and wind-drag on the toy. Some aerodynamic toys are also configured to create lift when launched through the air to increase the distance the toys travel before descending to the ground.

While hand-launchable, aerodynamic toys are well-suited for use in air, they are not well-suited for use underwater, because water is a different medium than air. For example, objects traveling through water experience a significantly higher amount of drag than do objects traveling through air, because water has a much higher density than air. Similarly, objects experience a greater buoyancy in water than in air due to the higher specific gravity of water than air. For these reasons, toys intended for use underwater should employ hydrodynamic rather than aerodynamic values and thus typically will have different combinations of size, shape, and weight, than those intended for use m air.

In my existing U.S. Pat. No. 5,514,023, the disclosure of which is hereby incorporated by reference, I disclosed a hand-launchable projectile toy that was hydrodynamically configured to travel substantial distances underwater. In addition to having an elongate, smoothly-contoured body, the toy included a plurality of stabilizing fins projecting radially from the tail section of the body. This toy is currently available from SwimWays Corp., of Virginia Beach, Va., under the trademark TOYPEDO®. Another example of a hand-launchable underwater projectile toy with radially projecting fins is the "Poolaris" toy distributed by Tony U.S.A., Inc., of Encinitas, Calif. At least one version of the "Poolaris" toy includes five radially projecting fins which are slightly inclined relative to the long axis of the projectile.

As disclosed in my prior patent, one embodiment of my earlier hydrodynamic projectile toy includes an elongate body with a generally cylindrical mid-section, and with generally rounded-conical nose and tail sections. The body of the projectile is sized to be comfortably gripped in a user's hand. The projectile is substantially neutrally-buoyant in most bodies of water, having a specific gravity of between approximately 0.90 and approximately 1.1. A fillable internal cavity enables a user to adjust the buoyancy by adding water to the cavity. The shape and surface preparation of the projectile body provide a drag coefficient of less than approximately 0.15. The combination of relatively high mass, adjustable buoyancy, and low hydrodynamic drag allow the projectile to be hand-launched to travel at high speed over large distances underwater. The radially projecting fins function to stabilize the projectile during underwater travel by providing righting-moments in the event the projectile undergoes yaw or pitch.

While my earlier hand-launchable, underwater projectile toy enables a wide range of aquatic recreation activities, additional games, contests, and other play and/or skill activities would be possible with hand-launchable, underwater projectile toys of different configurations.

SUMMARY OF THE INVENTION

The invention provides a hand-launchable underwater projectile toy which gives a user increased options for aquatic games, contests, and other activities. In one embodiment, the toy includes a hydrodynamic body having a nose section, a tail section, and a mid-section extending therebetween. The mid-section is sized for grasping by a user's hand, such as in the notch formed by the user's thumb and index finger. A novel trajectory stabilizing structure extends from the body and is configured to impart a righting-moment to the body during underwater travel. The stabilizing structure includes one or more drag-producing surfaces extending in a non-radial direction with respect to the central axis. In another embodiment, the toy includes a stabilizing structure with at least one portion that is user-adjustable to impart a selected steering-moment to the body during underwater travel.

In a further embodiment, the invention provides a self-orienting, hand-launchable underwater projectile toy. The body of the projectile includes a positively buoyant first portion, and a negatively buoyant second portion. When the toy is suspended in water, the first and second portions cooperate to urge the body into a selected orientation.

DETAILED DESCRIPTION

Figure 1:
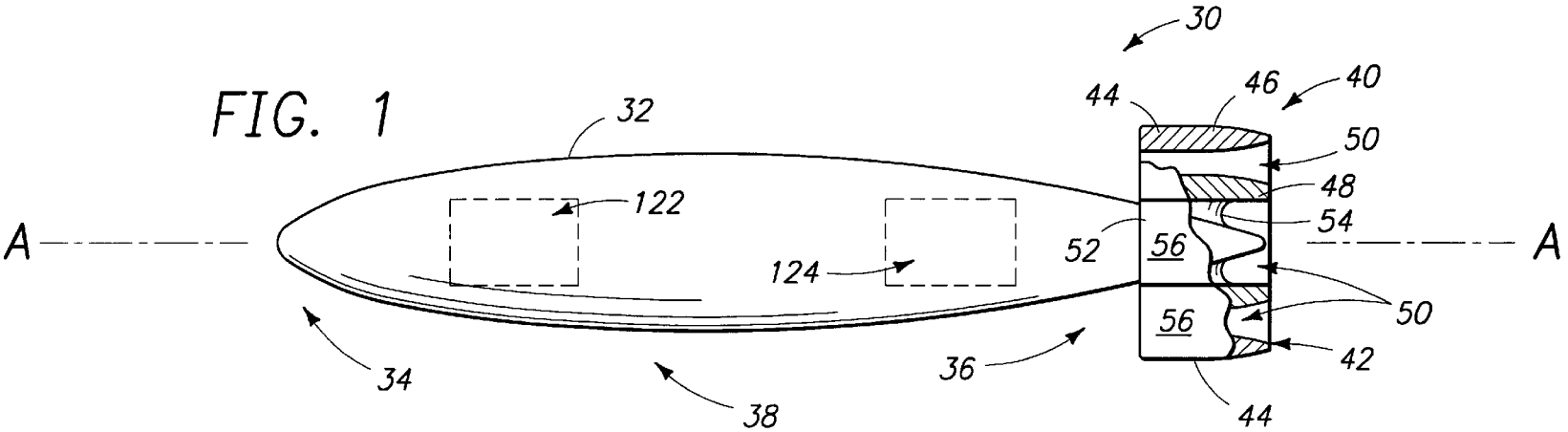
FIG. 1 is a side elevation view of a hand-launchable underwater projectile toy according to the present invention, showing the stabilizing structure in partial cut-away view.

A hand-launchable underwater projectile toy constructed in accordance with an embodiment of the present invention is shown in FIG. 1 and indicated generally at 30. Toy 30 is configured and constructed with selected hydrodynamic properties so that a user may hand-launch the toy along selected underwater trajectories, through which the toy will travel substantial distances underwater. Toy 30 includes a body 32 having a nose section 34, a tail section 36, and a mid-section 38 extending therebetween. A directional trajectory-stabilizing structure 40, having one or more drag-producing surfaces, extends from body 32 and imparts a righting-moment to the body during underwater travel. Optionally, stabilizing structure 40 includes at least one portion that is user-adjustable to impart a selected steering-moment to the body during underwater travel, thus providing additional possibilities for underwater performance.

It should be understood that while toy 30 is described herein as a hand-launchable toy, a user may also use other simple energy storage devices, such as rubber bands, surgical tubing or the like to launch the toy in a body of water. It should also be understood that while described as being an underwater toy that travels along an underwater trajectory, the path of the toy may include an initial aerial portion, such as when the toy is launched into a body of water by a user positioned at least partially out of the water.

Toy 30 is constructed to be generally neutrally-buoyant when suspended in water. This enables the toy to travel relatively long distances underwater without surfacing or striking the bottom of the body of water. Typically, this is achieved with a specific gravity in the range of approximately 0.7 and approximately 1.3, preferably in the range of approximately 0.8 and approximately 1.2, and more preferably in the range of approximately 0.9 and approximately 1.1. It is within the scope of the invention that toy 30 may have a specific gravity outside of this range. For example, toy 30 may include one or more fillable internal cavities (not shown) to allow a user to adjust the buoyancy of the toy, such as shown in my prior patent. In any event, the neutral, or near neutral, buoyancy of toy 30 ensures that the toy has little tendency to either sink to the bottom or float to the surface. Thus, the toy may be launched over substantial distances underwater while maintaining the trajectory imparted by the user. Typically, toy 30 will have a center of gravity or buoyancy forward of its center of pressure, to increase the glide path of the toy in the body of water, thereby increasing the horizontal distance the toy travels.

Alternatively, toy 30 may be constructed or adjusted to be positively buoyant to ensure the toy floats to the surface for easy retrieval. In this case, its center of buoyancy will preferably, but not necessarily, be forward of its center of pressure to maximize the distance of underwater travel before surfacing. As a further alternative, toy 30 may be constructed or adjusted to be negatively buoyant to cause the toy to sink to the bottom. For example, a positively buoyant versions of toy 30 may have a specific gravity in the range of approximately 0.95 and 0.7 or even 0.5, although it should be understood that the more positively buoyant the toy, the less horizontal distance it will travel when launched from underwater. On the other hand, a negatively buoyant version of toy 30 may have a specific gravity in the range of approximately 1.05 to 1.5 or 2.0 or higher.

Those of skill in the art will appreciate that toy 30 may be constructed with various hydrodynamic shapes and configurations. In the exemplary embodiment of FIG. 1, toy 30 is depicted having a torpedo-like shape. Body 32, which is preferably, but not necessarily, at least substantially symmetrical about a longitudinal central axis A, has an elongate, smoothly contoured form adapted to glide easily through water. As shown, nose section 34 is gently arcuately tapered with a generally parabolic cross-sectional profile, and tail section 36 is arcuately tapered in a reverse direction to nose section 34, with a somewhat more narrow cross-sectional profile than nose section 34. Other selected profiles may be used and are within the scope of the invention. At least a portion of mid-section 38 is sized to allow a user to easily grasp the mid-section in his or her hand by extending the thumb and one or more fingers at least partially around the mid-section. This grasping position allows the user to launch the projectile toy similar to launching a spear.

In FIG. 1, mid-section 38 has a generally circular cross-sectional configuration. However, it should be understood that other cross-sectional configurations may also be used. For example, the cross-section of mid-section 38 may be triangular, rectilinear, polygonal, oval, elliptical, or any other suitable shape. In addition, the outer surface of body 32 may be smooth, or may alternatively include topographic features such as ribbing, grooves, projections, protrusions, etc. Such features may be uniformly distributed over the surface of body 32, or may be arranged in a non-uniform pattern or distribution. As one example, toy 30 may include ribbing or grooves extending generally spirally around body 32.

While body 32 may be constructed to different sizes and proportions, the dimensions taught in my prior patent are typical. In summary, body 32 has a length of approximately 16-inches and a maximum diameter of approximately 2.7 inches, for a length-to-width ratio of approximately 5.9:1. It has been found that a body having these proportions and with a specific gravity of approximately 1.0 provides a substantially hydrodynamic profile when launched into a trajectory generally along the longitudinal axis. Alternatively, other lengths, widths, and/or length-to-width ratios may be used.

It will be appreciated that toy 30 may be constructed from a wide variety of water-compatible materials. As taught in my earlier patent, one suitable material is low-durometer polyurethane. In addition to having the desired hydrodynamic properties, this material is also relatively soft, thereby providing a toy that is both safe and fun for use by children. Other examples of suitable materials include silicone rubber, natural and synthetic rubbers and various plastics and polymers, although it is within the scope of the invention that any other suitable material for underwater children's toys may be used.

In use, toy 30 is launched by aligning longitudinal central axis A generally along the trajectory selected by the user, with nose section 34 positioned forward of tail section 36. Using the desired amount of force, the user then propels and releases the toy along the trajectory. As the toy travels through the water in a trajectory generally along longitudinal central axis A, a minimum amount of drag is experienced by body 32 due to its hydrodynamic configuration. To maintain this orientation of body 32 relative to its travel direction, trajectory stabilizing structure 40 produces righting-moments to the body in the event the body undergoes yaw or pitch during underwater travel.

As will be described in more detail below, stabilizing structure 40 may be embodied in a variety of configurations. In the embodiment depicted in FIGS. 1–3, stabilizing structure 40 is in the shape of a ring foil 42. Ring foil 42 has a generally annular exterior shape with a diameter somewhat larger than the maximum diameter of he body 32. However, ring foil structures of other sizes are also within the scope of the invention. Ring foil 42 is generally symmetrical about central longitudinal axis A and includes opposing flow-through wing members 44. Flow-through wing members 44 include arcuate sections 46 connected, at either end, to crossbars 48. Arcuate sections 46 and crossbars 48 form hollow water flow channels 50 which allow water to flow through is the stabilizing structure during underwater travel. Arcuately shaped side members 52 are spaced-apart and extend between opposing ends of the flow-through wing members to form the annular exterior surface of ring foil 42. Thus, water is also able to flow through the ring foil between side members 52. Ring foil 42 is connected to body 32 by wing mounts 54, which extend between the body and crossbars 48.

Arcuate sections 46, crossbars 48, and side members 52 include drag-producing surfaces 56. In contrast to the radially projecting fins of the toys described above, drag-producing surfaces 56 of ring foil 42 extend in a non-radial direction from central axis A. These drag-producing surfaces provide directional stability to toy 30 by creating strong righting-moments generally normal to the surfaces during underwater travel. The righting-moments sustain the longitudinal axis of the toy substantially in alignment with the trajectory of the toy. Optionally, one or more of arcuate sections 46, crossbars 48, and side members 52 may be formed with tapered or curved wing-foil surfaces to produce hydrodynamic lift during underwater travel. In any event, ring foil stabilizer 42 is configured to allow water to flow relatively smoothly past toy 30 while maintaining the toy in its hydrodynamic orientation.

As described above, the ring foil is generally symmetrical about, or with respect to, central axis A. As a result, the ring foil tends to sustain the underwater flight of the toy in a substantially straight-line trajectory. Furthermore, the trajectory of the toy is independent of the rotational position of the toy in the user's hand during launch. However, in an alternate embodiment, at least a portion of ring foil 42 is user-adjustable to alter the hydrodynamic performance of toy 30 and impart a steering-moment to the is body during underwater travel. This feature allows a user to change the trajectory of the toy to a selected non-linear path determined by the altered configuration of the ring foil and the rotational position of the toy in the user's hand during launch.

It will be appreciated that there are numerous ways to construct ring foil 42 to allow the user to modify the hydrodynamic performance of the toy. In the embodiment depicted in FIGS. 1–3, side members 52 are movably coupled to flow-through wing members 44, enabling the user to adjust one or both side members to provide the desired steering-moment. Specifically, each side member includes protruding pins 58 configured to engage corresponding sockets 60 on the lateral ends of the flow-through wing members. In the depicted embodiment, pins 58 are located generally centrally along the edges of the side members. However, it will be appreciated that pins 58 and sockets 60 may also be located fore or aft of their depicted locations. Furthermore, the pins may alternatively extend from the flow-through wing members to engage sockets in the side members.

Figure 2:
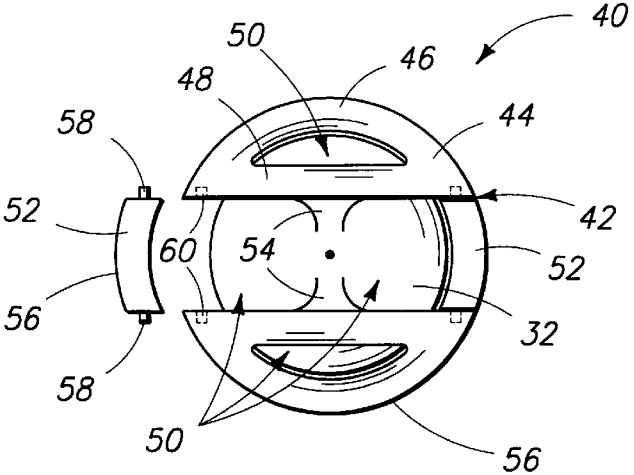
FIG. 2 is a rear elevation view of the underwater projectile toy of FIG. 1, showing how a portion of the stabilizing structure may be removed to adjust the drag coefficient and steering of the toy.

To adjust the trajectory of the toy, a user may remove one of the side members, as shown in FIG. 2. With one side member removed, the ring foil is asymmetric about the central axis, and produces asymmetric drag forces on the body. As a result, the trajectory of the toy tends to curve toward the remaining side member. Thus, the user can steer the toy by adjusting the rotational position of the toy at launch. For example, to steer the toy to the right, the user holds the toy with the remaining side member on the right.

Figure 3:
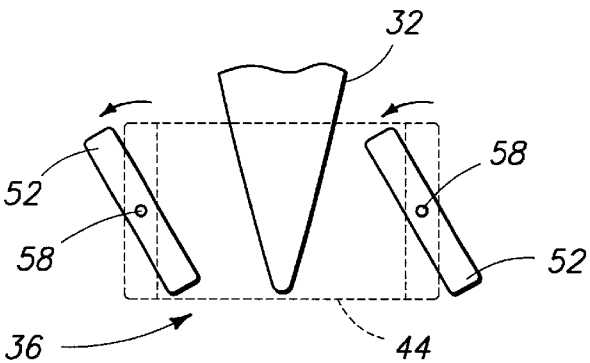
FIG. 3 is a fragmentary top plan view of the underwater projectile toy of FIG. 1, showing how one or more portions of the stabilizing structure may be adjusted to change the drag coefficient and steering of the toy.

As shown in FIG. 3, the user may also change the trajectory of the toy by pivoting one or both side members about the pin-and-socket coupling. Thus, the side members act as rudders to steer the toy in the desired direction. The steering-moment produced will be generally proportional to the pivot angle. Thus, the user can increase the curve of the trajectory by increasing the angle by which the side members are pivoted. Alternatively, one side member may be removed and the remaining side member pivoted to provide additional steering possibilities.

While side members 52 have been described above as being coupled to flow-through wing members 44 with pin-and-socket couplings, it will be appreciated that numerous other couplings are also possible and within the scope of the invention. For example, the side members may be integrally formed with the flow-through wing members in the embodiment in which the ring foil is not adjustable. As another example, the side members may be coupled to the flow-through wing members with rail and channel couplings as will be described in further detail below. Thus, it will be understood that while one exemplary embodiment of a ring foil has been depicted and described, the invention is not limited to any particular ring foil design.

Figure 4:
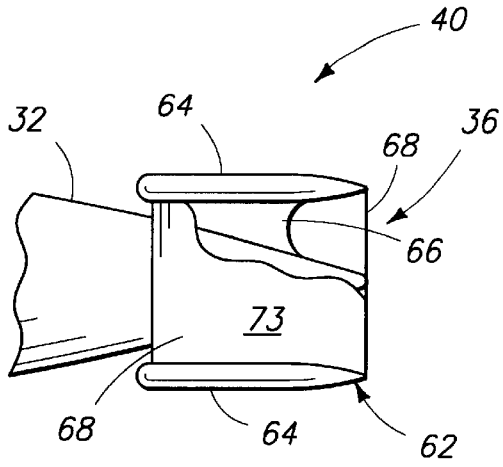
FIG. 4 is a fragmentary side elevation of another embodiment of the present invention, with a portion of the stabilizing structure shown in partial cut-away.
Figure 5:
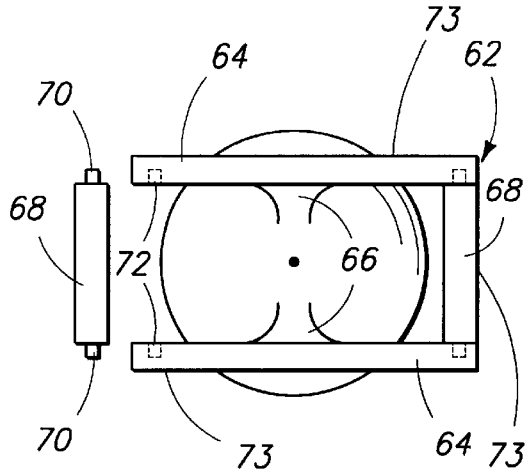
FIG. 5 is a rear elevation view of the underwater projectile toy of FIG. 4, showing how a portion of the stabilizing structure may be removed to adjust the drag coefficient and steering of the toy.

In addition to the ring foil stabilizing structure shown in FIGS. 1–3, toy 30 may alternatively employ a stabilizing structure having other forms as well. One such alternative stabilizing structure, referred to herein as a "box foil" 62, is shown in FIGS. 4 and 5. Box foil 62 includes a pair of spaced-apart, substantially parallel wing members 64 coupled to body 32 through wing mounts 66. A pair of side members 68, disposed on opposite sides of tail section 36, extend between the wing members.

Side members 68 may be integrally formed with wing members 64, or they may be movably coupled to the wing members to allow the user to adjust the hydrodynamic performance of the toy. In the depicted embodiment, side members 68 include pins 70 configured to engage sockets 72 in wing members 64. Similar to the ring foil embodiment described above, this pin-and-socket coupling allows one or both of the side members to be removed or pivoted to produce a steering-moment during underwater travel. Thus, by adjusting the side members and rotationally positioning the toy during launch, the user can steer the toy along a selected non-linear trajectory.

It will be appreciated that box foil 62 may be configured in various sizes as desired. Larger sized box foils generally will have larger drag-producing surfaces 73, and thus create larger righting-moments. As can best be seen in FIG. 5, wing members 64 of the exemplary embodiment are larger than side members 68. As a result, the righting moment produced along an axis perpendicular to the wing members typically will be larger than the righting moment produced along an axis perpendicular to the side members. Alternatively, the side members may be equal to, or larger than, the wing members, thereby producing equal or larger righting-moments, respectively. Furthermore, as discussed above, the righting-moments produced by the side members will depend on the user-selected position of the side members as well as their size. Thus, the user has control of the trajectory of the toy regardless of the sizes of the wing members and side members.

Figure 6:
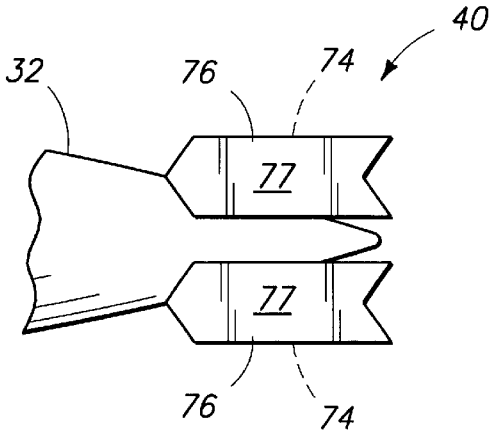
FIG. 6 is a fragmentary side elevation of another embodiment of the present invention.
Figure 7:
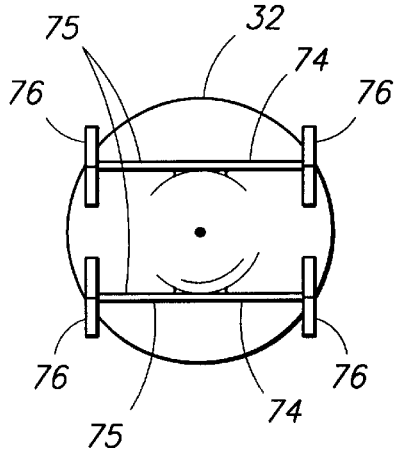
FIG. 7 is a rear elevation view of the underwater projectile toy of FIG. 6.

FIGS. 6 and 7 illustrate a further alternative embodiment of stabilizing structure 40. Similar to the box foil described above, the "bi-wing" embodiment depicted in FIGS. 6 and 7 includes a pair of spaced-apart, substantially parallel wing members 74 mounted onto body 32. Hydrodynamically shaped tail fins 76 are attached to, and run along, each of the ends of the wing members. As shown, fins 76 have a generally pointed, or arrow-shaped configuration, but it should be understood that any other suitable shape may be used, such as fins 76 that are more round or rectilinear than those shown in FIGS. 6 and 7. The drag-producing surfaces 73 of the wing members extend perpendicularly to the surfaces 77 of the tail fins and function to produce righting-moments generally transverse to the righting-moments produced by the tail fins. Optionally, tail fins 76 may be pivotally connected to wing members 74 to allow the user to adjust the angle of one or more of the tail fins relative to the corresponding wing member.

Figure 8:
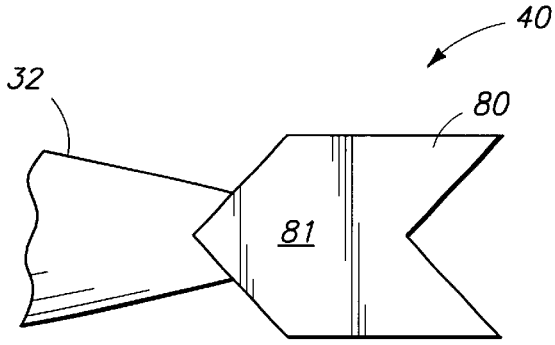
FIG. 8 is a fragmentary side elevation of another embodiment of the present invention.
Figure 9:
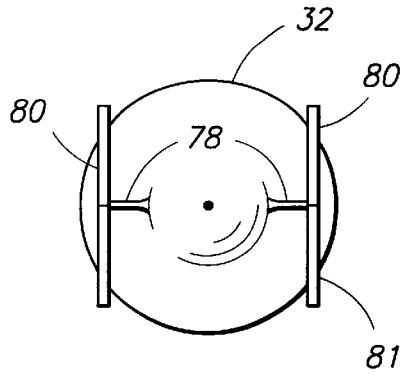
FIG. 9 is a rear elevation view of the underwater projectile toy of FIG. 8.

A further embodiment of stabilizing structure 40 is shown in FIGS. 8 and 9. In this embodiment, stabilizing structure 40 includes a pair of supports 78 extending from opposite sides of body 32. Attached to the end of each support is a fin 80, which extends generally perpendicular to the support. Fins 80 may be pivotally mounted on supports 78 to allow the user to adjust the angular position of one or both fins relative to the supports. Although shown as being generally arrow-shaped, fins 80 alternatively may be formed in any desired shape, such as round or rectilinear. It will be appreciated that the magnitudes of the righting-moments created by the drag-producing surfaces 81 of the fins will depend upon the size of the fins. In addition, supports 78 may also produce righting-moments depending on their sizes. Therefore, while stabilizing structure 40 is depicted in FIGS. 8 and 9 as having relatively large fins and relatively small supports, alternative stabilizing structures having relatively small fins and/or relatively large supports will also be within the scope of the invention.

Figure 10:
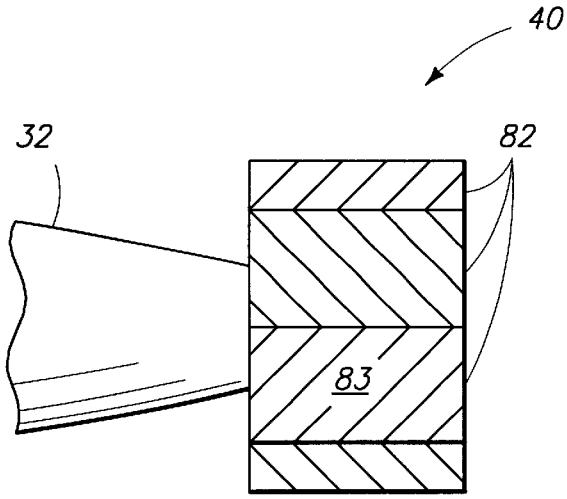
FIG. 10 is a fragmentary side elevation of another embodiment of the present invention.
Figure 11:
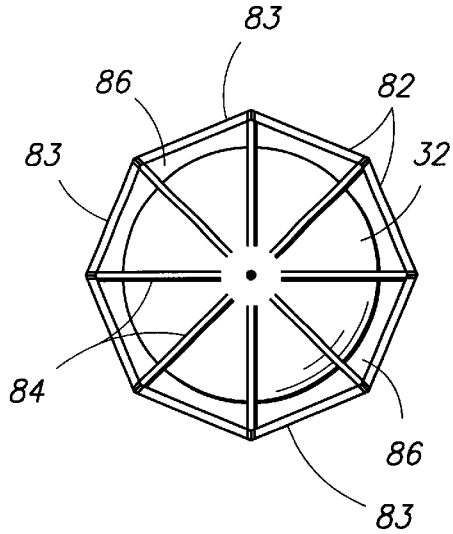
FIG. 11 is a rear elevation view of the underwater projectile toy of FIG. 10.

FIGS. 10 and 11 depict a further exemplary embodiment of the invention in which stabilizing structure 40 is formed with a polygonal fin configuration. In this embodiment, stabilizing structure 40 includes eight fins 82 with drag-producing surfaces 83 arranged in a substantially octagonal cylinder. Fins 82 are connected to body 32 by supports 84 which extend outward from tail section 36 to join adjacent fins. Stabilizing structure 40 also includes water flow channels 86 which allow water to flow through the stabilizing structure during underwater travel. Optionally, one or more of fins 82 may be adjustable and/or removable to allow a user to control the trajectory of toy 30. While this particular embodiment is described and depicted as having eight fins to form an octagonal shape, it will be appreciated that stabilizing structure 40 may be constructed using any number of fins to form triangles, squares, pentagons, hexagons, and any other selected polygonal configuration.

Figure 12:
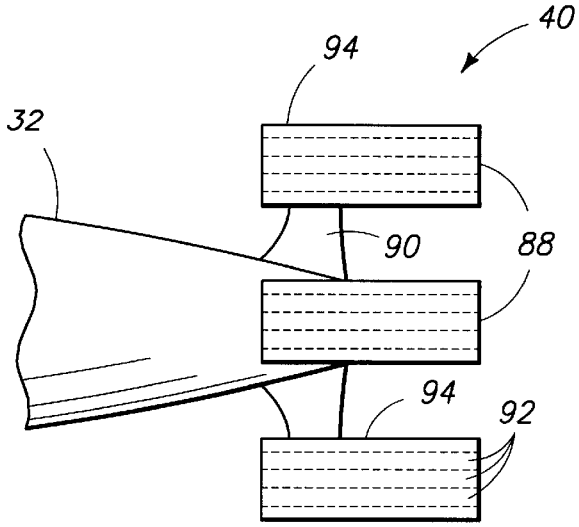
FIG. 12 is a fragmentary side elevation of another embodiment of the present invention.
Figure 13:
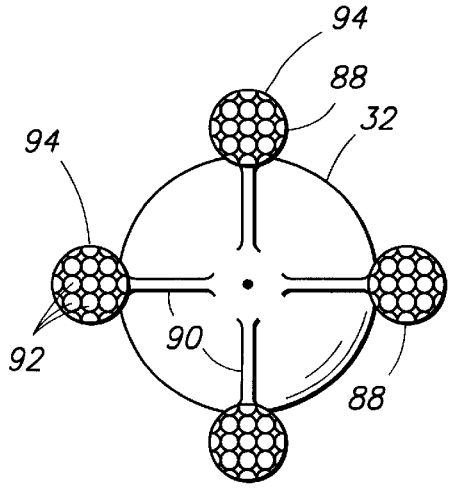
FIG. 13 is a rear elevation view of the underwater projectile toy of FIG. 12.

In a further embodiment, illustrated in FIGS. 12 and 13, stabilizing structure 40 includes a plurality of multi-barrel stabilizer tubes 88. Each tube is coupled to body 32 by a support 90, and includes one or more hollow, cylindrical barrels 92, through which water may flow. The drag-producing surfaces 94 of tubes 88 produce righting-moments during underwater travel, while hollow barrels 92 ensure that the stabilizing structure does not create excessive drag along the trajectory of the toy.

It will be appreciated that the embodiment of stabilizing structure 40 depicted in FIGS. 12 and 13 may be adjustable to enable the user to change the hydrodynamic performance of the toy. For example, the user may cover one or more of the tubes to increase the drag produced by surfaces 94, thereby altering the trajectory of the toy. Additionally, one or more of the tubes may be removably or pivotally mounted on the supports. Further, one or more of the tubes may be slidably mounted on the supports, such as by a rail and channel coupling, to enable the user to adjust the fore-aft position of the tube relative to body 32.

Figure 14:
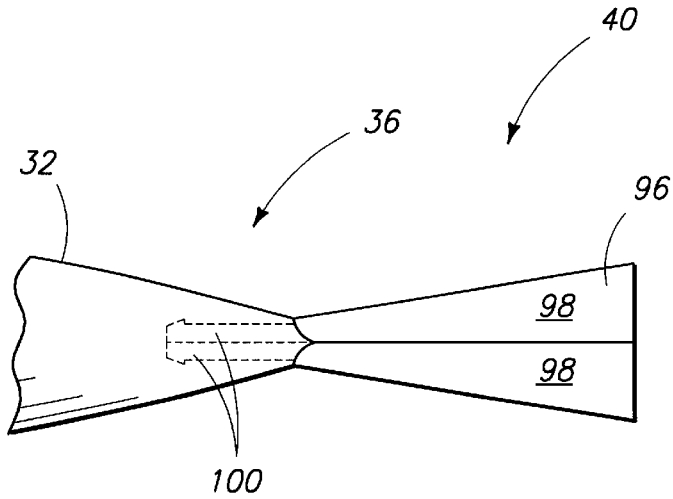
FIG. 14 is a fragmentary side elevation of another embodiment of the present invention.
Figure 15:
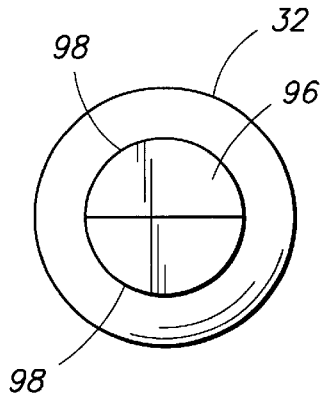
FIG. 15 is a rear elevation view of the underwater projectile toy of FIG. 14.

FIGS. 14 and 15 illustrate another embodiment in which stabilizing structure 40 is in the shape of a cone 96 extending outward from tail section 36. The drag-producing surface 98 of cone 96 creates strong righting-moments to correct the trajectory of toy 30 against pitch and yaw during underwater travel. Cone 96 may be integrally formed with body 32, or it may be formed in one or more sections that are removably coupled to the body. In the latter case, the sections may be coupled to body 32 by pins 100 which are received into tail section 36, or by alternative means of attachment. It will be appreciated that while cone 96 is depicted as being formed of two semi-conical sections, the cone may alternatively be formed of more than two sections as desired. In any event, the user may adjust the trajectory of toy 30 by removing one or more of the sections to change the hydrodynamic properties of the toy.

An additional aspect of cone stabilizing structure 96 is its radial symmetry. As can be seen from FIGS. 14 and 15, the drag-producing surface of cone 96 is at least substantially symmetrical about central axis A. The hydrodynamic performance of toy 30 is thus independent of its rotational orientation about the central axis, and the magnitude of the righting-moments produced will be uniform in all radial directions.

Figure 16:
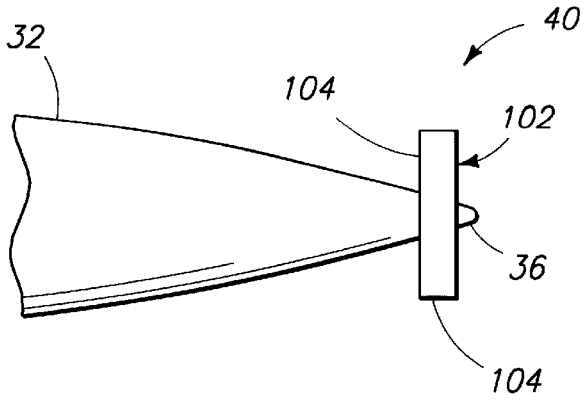
FIG. 16 is a fragmentary side elevation of another embodiment of the present invention.
Figure 17:
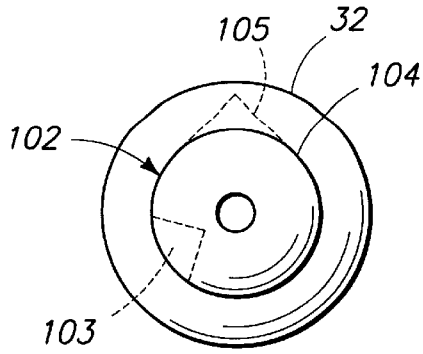
FIG. 17 is a rear elevation view of the underwater projectile toy of FIG. 16.

FIGS. 16 and 17 illustrate a further embodiment of the invention, in which stabilizing structure 40 is in the form of a disk 102. In the depicted embodiment, disk 102 has a hollow center configured to removably receive tail section 36. It will be appreciated, however, that disk 102 may be attached to body 32 by other means as well. For example, disk 102 may be integrally formed with body 32. In any event, the disk includes drag-producing surfaces 104 configured to provide directional stability to toy 30 during underwater travel. Similar to cone 96, disk 102 is at least substantially symmetrical about central axis A. While disk 102 is depicted as having a diameter less than the maximum diameter of body 32, it will be appreciated that the disk may alternatively be constructed with a diameter equal to, or larger than, the maximum diameter of the body.

As mentioned above, disk 102 may be removable from body 32 to allow the user to change the hydrodynamic performance of the toy. In addition, the user may replace disk 102 with one or more disks (not shown) that are larger or smaller, or have noncircular shapes. Furthermore, some embodiments of disks 102 may include one or more notches 103 and/or projections 105, to allow the user to adjust the steering of toy 30.

Figure 18:
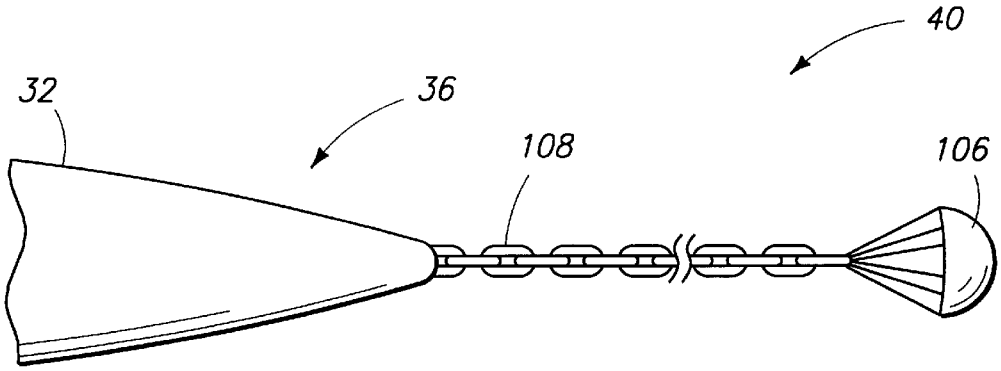
FIG. 18 is a fragmentary side elevation of another embodiment of the present invention.

A further embodiment is illustrated in FIG. 18. In this embodiment, stabilizing structure 40 is in the form of a parachute 106 connected to tail section 36 by a tether 108. As indicated by the broken lines, tether 108 may be constructed in any desired length, and may optionally include one or more removable sections (not shown) to allow a user to adjust the length of the tether. Furthermore, while tether 108 is depicted in the form of a single chain, it will be understood that the tether may alternatively include one or more of a variety of tether means, such as chain, rope, wire, string, etc. It should be further understood that other drag-inducing structures of any selected shape and size may be attached to tether 108 distal body 32.

In the depicted embodiment, tether 108 is attached to the rearmost portion of tail section 36. This configuration of stabilizing structure 40 is at least substantially symmetrical about central axis A, and tends to ensure that toy 30 maintains a straight-line trajectory during underwater travel. Alternatively, tether 108 may be adjustable to allow the user to attach the tether at other locations on body 32. For example, body 32 may include a plurality of distributed attachment means, such as hooks, to which tether 108 may be attached. This embodiment enables a user to adjust the hydrodynamic performance of the toy, and thereby produce steering moments to control the trajectory of the toy.

Those of skill in the art will appreciate that both parachute 106 and tether 108 function to impart righting-moments to body 32 during underwater travel. However, in another alternative embodiment, parachute 106 may be omitted or selectively removable so that only tether 108 provides directional stability to the toy. Conversely, tether 108 may be omitted and parachute 106 may be attached directly to body 32. In this alternative embodiment, directional stability is provided only by the parachute. Parachute 106 and/or tether 108 may be used alone or in combination with any of the other stabilizing structures disclosed herein.

Figure 19:
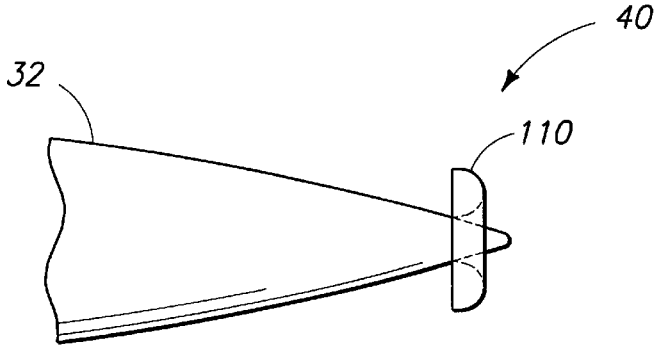
FIG. 19 is a fragmentary side elevation of another embodiment of the present invention.

FIG. 19 illustrates another embodiment, in which stabilizing structure 40 forms a bowl-shaped, concave deflector 110 as viewed along central axis A from fore to aft. The concave drag-producing surface of deflector 110 produces strong righting-moments during underwater travel to provide directional stability to toy 30. As with cone 96 and is disk 102, deflector 110 is substantially symmetrical about central axis A. Therefore, the trajectory of toy 30 will be independent of its rotational orientation about axis A. Of course, as with any of the other symmetrical structures disclosed herein, nonsymmetrical versions of these structures may be used, such as to produce a steering moment to the toy.

Figure 20:
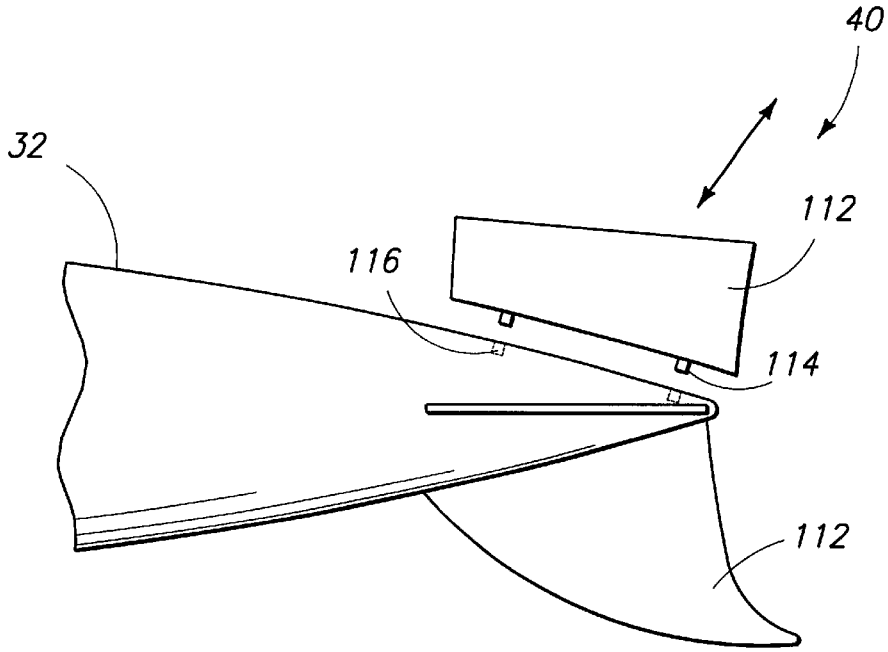
FIG. 20 is a fragmentary side elevation of another embodiment of the present invention having a stabilizing structure with radially projecting fins, and showing how one or more of the fins may be removed or replaced by fins of different sizes and/or shapes.
Figure 21:
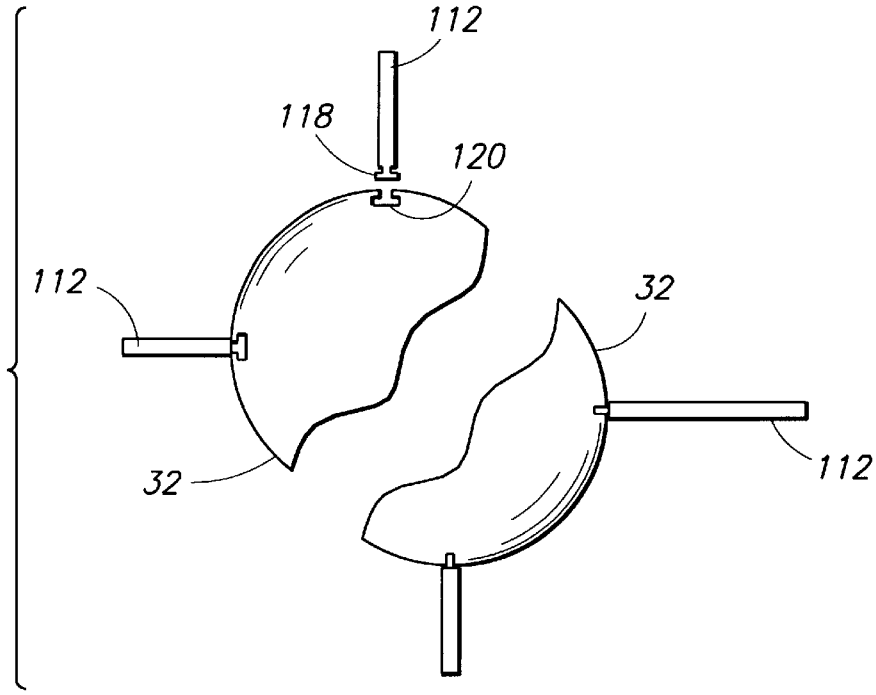
FIG. 21 is a rear elevation view showing alternate embodiments of the underwater projectile toy of FIG. 20. In the embodiment to the lower-right of the fragmentation line, the removable/adjustable fins are attached to the body of the toy by pins which extend from the fins into the body. In the embodiment to the upper-left of the fragmentation line, the removable/adjustable fins are attached to the body of the toy by rails which extend from the fms and are received into channels in the body.

FIGS. 20 and 21 illustrate a further alternative embodiment in which stabilizing structure 40 includes a plurality of radially projecting fins 112. In contrast to the radially projecting fins of the TOYPEDO® and "Poolaris" toys, fins 112 are configured to allow a user to control the trajectory of toy 30. In one embodiment, at least one fin has size or shape which is different than the remaining fins, thereby providing a different drag-producing surface. A user may then control the trajectory of the toy by adjusting the rotational orientation of the toy at launch.

Alternatively, one or more of fins 112 may be user-adjustable to enable a user to change the hydrodynamic performance of toy 30. Specifically, one or more of fins 112 are removably or adjustably coupled to body 30. Thus, a user may remove one or more fins to change the trajectory of toy 30. Alternatively, a user may remove one or more fins and install optional fins having different shapes, sizes, or other hydrodynamic properties. For example, fins may be shaped or oriented to impart a rotational, or spinning, moment to the toy about its axis A. Alternatively, one or more of fins 112 may be pivotally coupled to body 32 to enable a user to change the angular orientation of the fin relative to the body. In any event, the user-adjusted fin configuration creates a non-symmetrical stabilizing structure that imparts a steering-moment to the toy during underwater travel.

It will be appreciated by those of skill in the art that fins 112 may be removably and/or adjustably coupled to body 32 by any of a variety of mechanisms. For example, as can best be seen in FIG. 20, the fins may include pins 114 protruding from an edge of the fins to engage corresponding sockets 116 in body 32. Alternatively, the pins may protrude from the body to engage sockets in the fins. FIG. 21 shows a further example in which fins 112 have rails 118 along an edge to engage corresponding channels 120 in body 32. In addition to completely removing a fin, the rail and channel coupling allows a user to slide the fin along the surface of the body, thereby adjusting the fore-aft position of the fin relative to the body.

In other embodiments, body 32 includes one or more couplers for receiving complimentary couplers on the stabilizing structures depicted in FIGS. 1–19. For example, the stabilizing structures may be attached to the body by pin and socket couplings, rail and channel couplings, or any other suitable mounting structure. These embodiments allow a user to select from among several interchangeable stabilizing structures depending on the application. Additionally, the rail and channel coupling allows the user to slidably reposition the stabilizing structure relative to the body.

Toy 30 has been described above as being generally uniformly neutrally-buoyant when suspended in water. This ensures that the trajectory and orientation of toy 30 generally is not affected by the liquid medium. However, turning attention back to FIG. 1, an alternative embodiment of toy 30 includes a positively buoyant first portion 122 and/or a negatively buoyant second portion 124. While positively buoyant first portion 122 is depicted generally adjacent nose section 34, and negatively buoyant second portion is depicted generally adjacent tail section 36, it will be appreciated that is portions 122 and 124 may be positioned as necessary to achieve the desired hydrodynamic performance. Furthermore, while portions 122 and 124 are illustrated schematically, it will be appreciated that they may be formed in any desired shape.

The placement of first portion 122 forward of second portion 124 will cause toy 30 to self-orient to a generally vertical position in which nose section 34 is above tail section 36. Conversely, placing first portion 122 aft of second portion 124 will cause toy 30 to self-orient to a generally vertical position in which the nose section is below the tail section. Moreover, the relative buoyancies of first portion 122 and second portion 124 will also affect the performance of toy 30. For example, if the positive buoyancy of first portion 122 is greater than the negative buoyancy of second portion 124, then the overall buoyancy of toy 30 may be positive, causing the toy to float to the surface. Conversely, if the positive buoyancy of first portion 122 is less than the negative buoyancy of second portion 124, then the overall buoyancy of toy 30 may be negative, causing the toy to sink. In one alternative embodiment, the buoyancies of first portion 122 and/or second portion 124 are adjustable (e.g., by fillable internal cavities) to enable a user to change the performance of the toy. To achieve the varying buoyancies, toy 30 may be constructed using any of a wide variety of suitable materials, including positively-buoyant closed-cell foam, negatively-buoyant rubber, etc. Additionally, materials which are normally positively-buoyant may be given negative buoyancy by adding a weighted material such as lead shot, sand or other dense material. Materials which are normally negatively-buoyant may be given positive buoyancy by forming air pockets, etc., in the material.

It will be appreciated that any of the embodiments of toy 30 described above and depicted in FIGS. 1–21 may be constructed to include positively buoyant first portion 122 and negatively buoyant second portion 124. The self-orienting feature thus offers play options in addition to those provided by the various stabilizing structures. For example, where the overall buoyancy of toy 30 is negative, users may launch the toy along a selected underwater trajectory, and then dive to retrieve the toy from the bottom of the body of water. Furthermore, by selected positioning of the positively and negatively buoyant portions of the toy to provide a non-uniform buoyancy throughout the toy, the toy will be biased to achieve a selected orientation at the bottom of the body of water. To prevent injury due to a collision between the toy and a user, the toy may be constructed of materials that are generally flexible, collapsible, deformable, and/or resilient. Additionally or alternatively, toy 30 may be constructed to be collapsible or deformable upon collision.

While the invention has been disclosed in its preferred form, the specific embodiments thereof as disclosed and illustrated herein are not to be considered in a limiting sense as numerous variations are possible. Applicant regards the subject matter of the invention to include all novel and non-obvious combinations and subcombinations of the various elements, features, functions and/or properties disclosed herein. No single feature, function, element or property of the disclosed embodiments is essential to all embodiments. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are different, broader, narrower or equal in scope to the original claims, are also regarded as included within the subject matter of applicant's invention.

I claim:

1. A hand-launchable underwater projectile toy, comprising:

a hydrodynamic body including a nose section, a tail section, and a mid-section extending therebetween, the mid-section being sized for grasping in a user's hand such that a user's thumb and at least one finger may extend at least substantially around the mid-section to grasp, support and manually propel the toy along an underwater trajectory through a body of water; and a trajectory stabilizing structure extending from the tail section of the body and configured to impart a righting-moment to the body during underwater travel, wherein the stabilizing structure extends in a non-radial direction with respect to a longitudinal central axis of the body and includes one or more drag-producing surfaces, wherein the body and trajectory stabilizing structure are free from flow passages that extend through at least one of the body and the trajectory stabilizing structure and through which water may flow as the toy travels through the body of water.

2. The toy of claim 1, wherein the stabilizing structure is adapted to be selectively repositioned relative to the body.

3. The toy of claim 1, wherein the stabilizing structure is slidably coupled to the body.

4. The toy of claim 1, wherein the stabilizing structure includes at least one portion that is adjustable to provide a user-selected steering moment to the toy as the toy is propelled through the body of water.

5. The toy of claim 1, wherein the stabilizing structure includes at least one portion that is adapted to be selectively removed from the stabilizing structure and reattached thereto.

6. The toy of claim 1, wherein the stabilizing structure includes at least one portion that is pivotal relative to an axis extending at least generally transverse to the central axis.

7. The toy of claim 1, wherein the toy is further adapted to be selectively launched by a simple energy storage device.

8. The toy of claim 1, wherein the one or more drag-producing surfaces includes a ring foil.

9. The toy of claim 1, wherein the one or more drag-producing surfaces includes a box foil.

10. The toy of claim 1, wherein the one or more drag-producing surfaces includes a bi-wing structure.

11. The toy of claim 1, wherein the one or more drag-producing surfaces includes a tail fin attached to the body by a support, wherein at least a portion of the tail fin extends at least generally perpendicular to the support.

12. The toy of claim 1, wherein the one or more drag-producing surfaces includes a portion having a plurality of surfaces arranged in a polygonal configuration.

13. The toy of claim 1, wherein the one or more drag-producing surfaces includes a conical portion having a proximate portion extending at least generally rearward from the tail section and having a diameter, and further wherein the conical portion includes a distal portion of wider diameter rearward of the proximate portion.

14. The toy of claim 1, wherein the one or more drag-producing surfaces includes a tether extending rearwardly from the body.

15. The toy of claim 1, wherein the one or more drag-producing surfaces includes a parachute.

16. The toy of claim 1, wherein the one or more drag-producing surfaces includes a plurality of fins, at least one of the fins having at least one of a different size and a different shape than another one of the fins.

17. The toy of claim 1, wherein the toy has a specific gravity in a range of 0.7 and 1.3.

18. The toy of claim 1, wherein the toy has a specific gravity that is greater than 1.

19. The toy of claim 1, wherein the toy has a center of gravity and a center of pressure, and further wherein the center of gravity is located closer to the nose section of the body than the center of pressure.

20. The toy of claim 1, wherein the toy is configured to retain a generally horizontal underwater configuration in the body of water.

21. The toy of claim 1, wherein the toy is formed from a waterproof material.

22. The toy of claim 1, wherein the toy is at least substantially formed from at least one material selected from a group consisting of plastics, polymers, rubber, and polyurethane.

23. A steerable, hand-launchable underwater projectile toy, comprising:

a hydrodynamic body sized for grasping in a user's hand such that a user's thumb and at least one finger may extend at least substantially around the body to grasp, support and manually propel the toy along an underwater trajectory through a body of water; and a stabilizing structure extending from the body and including at least one adjustable portion that is user-adjustable to impart a selected steering-moment to the body during underwater travel, wherein the steering-moment is adapted to bias the toy along a non-linear trajectory as the toy travels through the body of water.

24. The toy of claim 23, wherein the adjustable portion is selectively pivotal with respect to the body.

25. The toy of claim 23, wherein the adjustable portion is adapted to be selectively removable from, and replaceable on, the body.

26. The toy of claim 23, wherein the adjustable portion is repositionable relative to the body.

27. The toy of claim 23, wherein the stabilizing structure is slidably coupled to the body.

28. The toy of claim 23, wherein the stabilizing structure is attached to the body by a rail and channel coupling.

29. The toy of claim 23, wherein the stabilizing structure is attached to the body by a pin-and-socket coupling.

30. The toy of claim 23, wherein the toy is adapted to be launched by a simple energy storage device.

31. The toy of claim 23, wherein the body includes a positively buoyant first portion and a negatively buoyant second portion, wherein the first and second portions cooperate to urge the body into a selected orientation in water.

32. The toy of claim 31, wherein the first and second portions cooperate to urge the body into a generally vertical orientation in water.

33. The toy of claim 31, wherein the buoyancy of at least one of the portions is adjustable.

34. The toy of claim 31, wherein the toy is further adapted to be selectively launched by a simple energy storage device.

35. The toy of claim 31, wherein the body is formed of a collapsable material.

36. The toy of claim 23, wherein the toy has a specific gravity in a range of 0.7 and 1.3.

37. The toy of claim 36, wherein the toy has a specific gravity in a range of 0.8 and 1.2.

38. The toy of claim 23, wherein the toy has a nose portion, a center of gravity and a center of pressure, and further wherein the center of gravity is located closer to the nose portion than the center of pressure.

39. The toy of claim 23, wherein the toy is configured to retain a generally horizontal configuration in the body of water.

40. The toy of claim 23, wherein the toy is formed from a waterproof material.

41. The toy of claim 23, wherein the toy is at least substantially formed from at least one material selected from a group consisting of plastics, polymers, rubber, and polyurethane.

42. An underwater projectile toy kit, comprising:

a body adapted to be hand-launched along an underwater trajectory and including one or more couplers, wherein the body has a specific gravity that is greater than or equal to 1; and a plurality of stabilizing members selectively mountable on the body to impart steering-moments to the body during underwater travel, wherein each member includes one or more couplers adapted to releasably engage one or more of the couplers on the body.

43. The kit of claim 42, wherein the plurality of stabilizing members includes members having different sizes or shapes.

44. The kit of claim 42, wherein at least one of the plurality of stabilizing members includes a portion that is user-adjustable.

45. The kit of claim 42, wherein the body is further adapted to be launched along an underwater trajectory by a simple energy storage device.

46. The kit of claim 45, wherein the kit further includes a simple energy storage device.

47. The kit of claim 46, wherein the simple energy storage device includes at least one elastic band.

48. A hand-launchable underwater projectile toy, comprising:

a hydrodynamic body including a nose section, a tail section, and a mid-section extending therebetween, the mid-section being sized for grasping in a user's hand such that a user's thumb and at least one finger may extend at least substantially around the mid-section to grasp, support and manually propel the toy along an underwater trajectory through a body of water; and a trajectory stabilizing structure extending from the tail section of the body and configured to impart a righting-moment to the body during underwater travel, wherein the stabilizing structure includes a disk-shaped portion defining a solid plane extending at least generally transverse to a longitudinal central axis of the body, wherein the disk-shaped portion is free from apertures through which water may flow as the toy travels through the body of water.

49. The toy of claim 48, wherein the toy has a specific gravity in a range of 0.7 and 1.3.

50. The toy of claim 48, wherein the toy has a nose portion, a center of gravity and a center of pressure, and further wherein the center of gravity is located closer to the nose portion than the center of pressure.

51. The toy of claim 48, wherein the toy is configured to retain a generally horizontal configuration in the body of water.

52. The toy of claim 48, wherein the toy is formed from a waterproof material.

53. The toy of claim 48, wherein the toy is at least substantially formed from at least one material selected from a group consisting of plastics, polymers, rubber, and polyurethane.

54. The toy of claim 48, wherein the toy has a specific gravity that is greater than or equal to 1.

55. A hand-launchable underwater projectile toy, comprising:

a hydrodynamic body including a nose section, a tail section, and a mid-section extending therebetween, the mid-section being sized for grasping in a user's hand such that a user's thumb and at least one finger may extend at least substantially around the mid-section to grasp, support and manually propel the toy along an underwater trajectory through a body of water; and a trajectory stabilizing structure extending from the tail section of the body and configured to impart a righting-moment to the body during underwater travel, wherein the stabilizing structure includes one or more drag-producing surfaces extending in a non-radial direction with respect to a longitudinal central axis of the body, and further wherein the stabilizing structure includes at least one portion that is adjustable to provide a user-selected steering moment to the toy as the toy is propelled through the body of water.

56. The toy of claim 55, wherein the stabilizing structure includes at least one portion that is pivotal relative to an axis extending at least generally transverse to the central axis.

57. The toy of claim 55, wherein the toy has a specific gravity in a range of 0.7 and 1.3.

58. The toy of claim 55, wherein the toy has a specific gravity that is greater than or equal to 1.

59. The toy of claim 55, wherein the at least one portion is selectively positionable relative to the body to provide a user-selected steering-moment to the toy as the toy is propelled through the body of water, and further wherein the user-selected steering-moment is adapted to bias the toy along a non-linear path as the toy is propelled through the body of water.

60. A hand-launchable underwater projectile toy, comprising:

a hydrodynamic body including a nose section, a tail section, and a mid-section extending therebetween, the mid-section being sized for grasping in a user's hand such that a user's thumb and at least one finger may extend at least substantially around the mid-section to grasp, support and manually propel the toy along an underwater trajectory through a body of water; and a trajectory stabilizing structure extending from the tail section of the body and configured to impart a righting-moment to the body during underwater travel, wherein the stabilizing structure includes one or more drag-producing surfaces extending in a non-radial direction with respect to a longitudinal central axis of the body, and further wherein the stabilizing structure includes at least one portion that is adapted to be selectively removed from the stabilizing structure and reattached thereto.

61. The toy of claim 60, wherein the toy has a specific gravity in a range of 0.7 and 1.3.

62. The toy of claim 60, wherein the toy has a specific gravity that is greater than or equal to 1.

63. A hand-launchable underwater projectile toy, comprising:

a hydrodynamic body including a nose section, a tail section, and a mid-section extending therebetween, the mid-section being sized for grasping in a user's hand such that a user's thumb and at least one finger may extend at least substantially around the mid-section to grasp, support and manually propel the toy along an underwater trajectory through a body of water; and a trajectory stabilizing structure extending from the tail section of the body and configured to impart a righting-moment to the body during underwater travel, wherein the stabilizing structure includes one or more drag-producing surfaces extending in a non-radial direction with respect to a longitudinal central axis of the body, and further wherein the toy is further adapted to be selectively launched by a simple energy storage device.

64. The toy of claim 63, wherein the toy has a specific gravity in a range of 0.7 and 1.3.

65. The toy of claim 63, wherein the toy has a specific gravity that is greater than or equal to 1.

66. A hand-launchable underwater projectile toy, comprising:

a hydrodynamic body including a nose section, a tail section, and a mid-section extending therebetween, the mid-section being sized for grasping in a user's hand such that a user's thumb and at least one finger may extend at least substantially around the mid-section to grasp, support and manually propel the toy along an underwater trajectory through a body of water; and a trajectory stabilizing structure extending from the tail section of the body and configured to impart a righting-moment to the body during underwater travel, wherein the stabilizing structure includes one or more drag-producing surfaces extending in a non-radial direction with respect to a longitudinal central axis of the body, and further wherein the one or more drag-producing surfaces includes a bi-wing structure.

67. The toy of claim 66, wherein the toy has a specific gravity in a range of 0.7 and 1.3.

68. The toy of claim 66, wherein the toy has a specific gravity that is greater than or equal to 1.

69. A hand-launchable underwater projectile toy, comprising:

a hydrodynamic body including a nose section, a tail section, and a mid-section extending therebetween, the mid-section being sized for grasping in a user's hand such that a user's thumb and at least one finger may extend at least substantially around the mid-section to grasp, support and manually propel the toy along an underwater trajectory through a body of water; and a trajectory stabilizing structure extending from the tail section of the body and configured to impart a righting-moment to the body during underwater travel, wherein the stabilizing structure includes one or more drag-producing surfaces extending in a non-radial direction with respect to a longitudinal central axis of the body, and further wherein the one or more drag-producing surfaces includes a plurality of fins, at least one of the fins having at least one of a different size and a different shape than another one of the fins.

70. The toy of claim 69, wherein the toy has a specific gravity in a range of 0.7 and 1.3.

71. The toy of claim 69, wherein the toy has a specific gravity that is greater than or equal to 1.

72. An underwater projectile toy kit, comprising:

a body adapted to be hand-launched along an underwater trajectory and including one or more couplers, wherein the body has a specific gravity that is greater than or equal to 1; and a plurality of stabilizing members selectively mountable on the body to impart righting-moments to the body during underwater travel, wherein each member includes one or more couplers adapted to releasably engage one or more of the couplers on the body.

73. The kit of claim 72, wherein the plurality of stabilizing members includes members having different sizes or shapes.

74. The kit of claim 72, wherein at least one of the plurality of stabilizing members includes a portion that is user-adjustable.

75. The kit of claim 72, wherein the body is further adapted to be launched along an underwater trajectory by a simple energy storage device.

76. The kit of claim 75, wherein the kit further includes a simple energy storage device.

77. The kit of claim 76, wherein the simple energy storage device includes at least one elastic band.

* * * * *